US005806541A

United States Patent [19]

Cooper et al.

[11] Patent Number: 5,806,541

[45] Date of Patent: Sep. 15, 1998

[54] ENHANCED DRAINING AND DRYING CYCLES FOR AN AUTOMATIC DISHWASHER

[75] Inventors: Randall L. Cooper, Newton; Mitchell N. Corbett, Clive; Mark A. Cracraft, Urbandale, all of Iowa

[73] Assignee: Maytag Corporation, Newton, Iowa

[21] Appl. No.: 853,529

[22] Filed: May 9, 1997

Related U.S. Application Data

[62] Division of Ser. No. 488,742, Jun. 8, 1995, Pat. No. 5,669,983, which is a division of Ser. No. 422,124, Apr. 12, 1995, Pat. No. 5,611,867.

[51] Int. Cl.[6] ..... B08B 3/10

[52] U.S. Cl. ..... 134/57 D; 134/56 D; 134/58 D; 134/113; 134/105

[58] Field of Search ..... 134/56 D, 57 D, 134/58 D, 105, 102.3, 113

[56] References Cited

U.S. PATENT DOCUMENTS

| | | |
|---|---|---|
| 3,114,253 | 12/1963 | Morey et al. . |
| 3,539,153 | 11/1970 | Wennerberg . |
| 3,807,418 | 4/1974 | Jenkins . |
| 3,870,417 | 3/1975 | Bashark . |
| 3,888,269 | 6/1975 | Bashark . |
| 3,903,909 | 9/1975 | Noren et al. . |
| 4,038,103 | 7/1977 | Grunewald . |
| 4,227,546 | 10/1980 | Bergeson . |
| 4,392,891 | 7/1983 | Meyers . |
| 4,468,333 | 8/1984 | Geiger . |
| 4,559,959 | 12/1985 | Meyers . |
| 4,810,306 | 3/1989 | Noren . |
| 5,223,042 | 6/1993 | Milocco . |
| 5,297,307 | 3/1994 | Baek . |
| 5,331,177 | 7/1994 | Kubisiak et al. . |
| 5,525,161 | 6/1996 | Milocco et al. . |

*Primary Examiner*—Frankie L. Stinson
*Attorney, Agent, or Firm*—Zarley, McKee, Thomte, Voorhees, & Sease

[57] ABSTRACT

An automatic dishwashing machine includes enhanced drying and draining cycles. Toward the end of the rinse and hold cycle when the water is draining, a second quantity of water is added to the machine resulting in a purging action which reduces the concentration of soil in the wash pump. During the normal wash cycle, if the dishwashing machine determines that the water is sufficiently dirty, a second drain is initiated to remove any dirty water that is present in the bottom of the pump after the first drain. During the dry cycle, the machine senses the temperature of the water and the presence of a rinse aid to select an appropriate dry cycle. The possible dry cycles include a delayed dry cycle and a pulsed dry cycle.

7 Claims, 7 Drawing Sheets

ENHANCED DRAINING AND DRYING CYCLES FOR AN AUTOMATIC DISHWASHER

This application is a divisional of application Ser. No. 08/488,742, filed Jun. 8, 1995, now U.S. Pat. No. 5,669,983, which is a divisional of application Ser. No. 08/422,124 filed on Apr. 12, 1995 now U.S. Pat. No. 5,611,867.

BACKGROUND OF THE INVENTION

1. Field of the Invention

The present invention relates to automatic dishwashing machines. More particularly, the present invention relates to a method and apparatus for improving the draining and drying cycles of an automatic dishwashing machine.

2. Problems in the Art

Typical prior art dishwashing machines have draining and drying cycles that are limited in a number of ways. A prior art appliance may include a draining cycle that simply drains the water from the appliance until a predetermined time has elapsed. Likewise, the drying cycle for a prior art appliance may simply call for a constant amount of heat for a predetermined amount of time.

When a user loads a dishwasher with dishes but anticipates a long delay before the dishwasher is run, the user should sometimes first rinse the dishes so that food and soil will not become dried and caked onto the dishes. If the dishwasher has a rinse and hold feature, the user can place the dishes in the dishwasher and the dishwasher will briefly rinse them. However, after using the rinse and hold function, there will probably be some soil and food present in the dishwasher. As a result, the soil could be redeposited on the dishes when the water is circulated later. Further, the food can create undesirable odors within the dishwasher if left for an extended period of time.

During a normal wash cycle, heavily soiled loads may cause the drain pump to loose the siphon effect at the end of the drain period which leaves a small amount of dirty water at the bottom of the pump generally known as carry over. As a result, at the beginning of the next wash cycle, a lesser amount of clean water will be introduced into the machine resulting in dirtier than normal water at the start of a new cycle. Also, the dirty water left in the dishwasher will increase soil concentration in the water which will create more redeposited soil on the dishes when the water is circulated.

During a dishwashing cycle, certain substances in the water may cause the water to foam and not wash the dishes effectively. These substances include detergents, eggs, powdered milk, etc. In the same manner, when there is a lot of material in the water the material may cause the dishwasher pump to "starve" resulting in poor circulation of the water. Both of these conditions reduce the effectiveness of the dishwasher. A normal prior art dishwashing cycle may not be able to overcome these undesirable conditions.

The drying cycles in prior art appliances are typically the same for a user selected cycle regardless of the conditions in the dishwasher. For example, if the water temperature is very high, then it takes less energy to dry the dishes than it would if the water was cooler. Similarly, if a rinse aid is present in the water it also takes less time and energy to dry the dishes. Prior art dishwashers cannot take these factors into account when drying the dishes resulting in reduction in effectiveness and efficiency. Also, different types of dishes react to drying in different ways. As a result, for prior art dishwashers to dry all types of dishes, the effectiveness and efficiency in drying certain types of dishes is reduced. Another problem with prior art dishwashers is that plastic dishes can melt if subjected to high temperatures. As a result, heat sources are selected with wattages such that they would not melt plastic dishes even though a heat source with a greater wattage may be more effective for other types of dishes.

OBJECTS OF THE INVENTION

A general object of the present invention is the provision of an appliance with improved rinsing and drying capabilities.

A further object of the present invention is the provision of an appliance having an advanced rinse and purge cycle.

A further object of the present invention is the provision of a dishwasher capable of detecting and correcting foaming and starving conditions in the dishwasher pump.

A further object of the present invention is the provision of a dishwasher having an improved rinse and hold cycle wherein additional water is added during the last portion of the drain to reduce the concentration of food and soil in the wash pump.

A further object of the present invention is the provision of a dishwasher having an improved drying cycle.

A further object of the present invention is the provision of a dishwasher having a drying cycle which is automatically adjustable based on the water temperature and the presence of a rinse additive.

A further object of the present invention is the provision of a dishwasher which automatically selects either a pulsed dry cycle or a delayed dry cycle depending on the temperature of the water.

A still further object of the present invention is the provision of an improved dishwasher dry cycle wherein the dry time for a particular dish material is determined by monitoring the temperature rise during the wash portion of the cycle of operations.

These as well as other objects of the present invention will become apparent from the following specification and claims.

SUMMARY OF THE INVENTION

The enhanced draining and drying cycles of the present invention are used to improve the performance of an automatic dishwasher. During the rinse and hold cycle, a first batch or quantity of water is circulated in the dishwasher to rinse off the articles in the dishwasher. The water is then drained, but before the draining is complete another batch or quantity of water is added resulting in a purging action which reduces the concentration of soil in the wash pump. During the normal wash cycle, the draining of the dishwasher is improved by initiating a first drain and then initiating a second drain to remove any dirty water that is present in the bottom of the pump.

During the dry cycle, the dishwasher senses the water temperature and the presence of a rinse aid to control the dry cycle. If the temperature is below a certain value and/or no rinse aid is detected in the final rinse, then the amount of time that the blower operates in the dry cycle will be increased. The temperature of the water is also used to choose the dry sequence used during the dry cycle. If the temperature of the water is above a certain value, then a delayed heat sequence is used. If the water is less than a certain value then a pulsed heat sequence is used.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
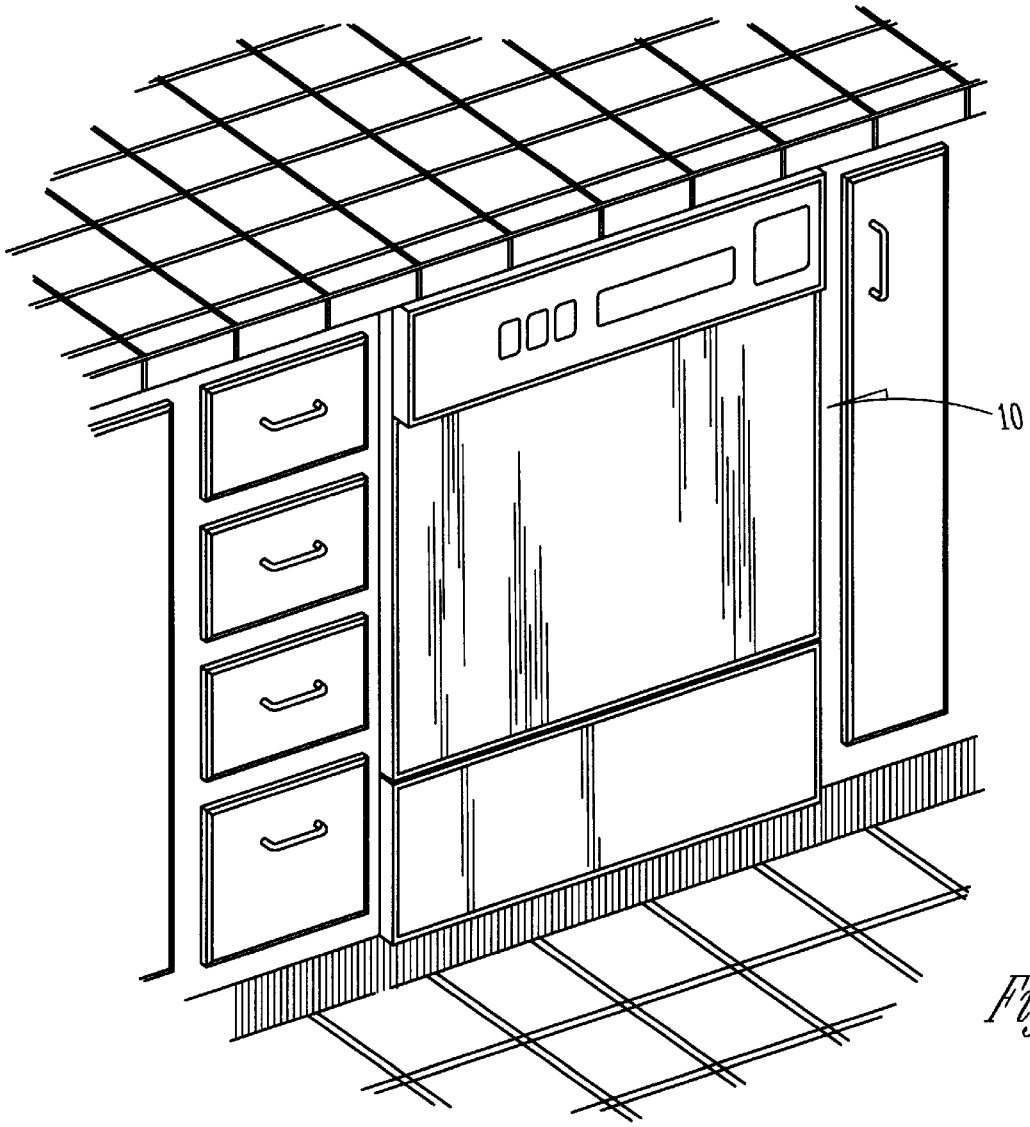
FIG. 1 is an isometric view of the dishwasher of the present invention.
Figure 2:
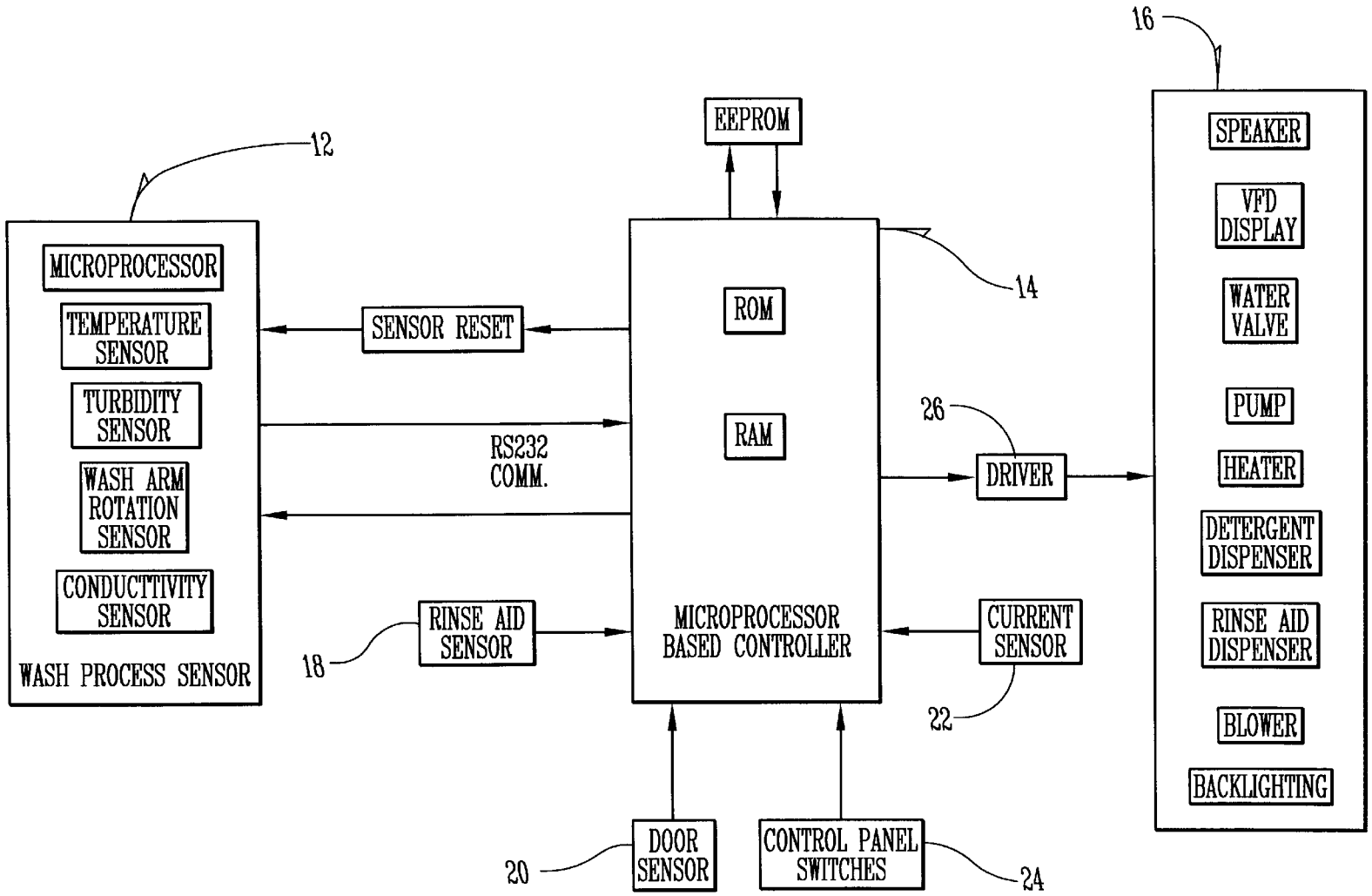
FIG. 2 shows a block diagram of the automatic dishwasher of the present invention.

The preferred embodiment of the present invention relates to an intelligent dishwasher 10 as shown in FIG. 1. FIG. 2 shows a block diagram of the dishwasher 10 using the present invention. FIG. 2 includes a wash process sensor block 12, a microprocessor based controller block 14, and an output block 16. Generally, the controller 14 receives inputs from the wash process sensor block 12, the rinse aid sensor 18, the door sensor 20, the current sensor 22, and the control panel switches 24. The controller 14 uses these inputs to control a transistor driver 26 which in turn drives the various components and functions of the dishwasher as shown in the output block 16.

Figure 3:
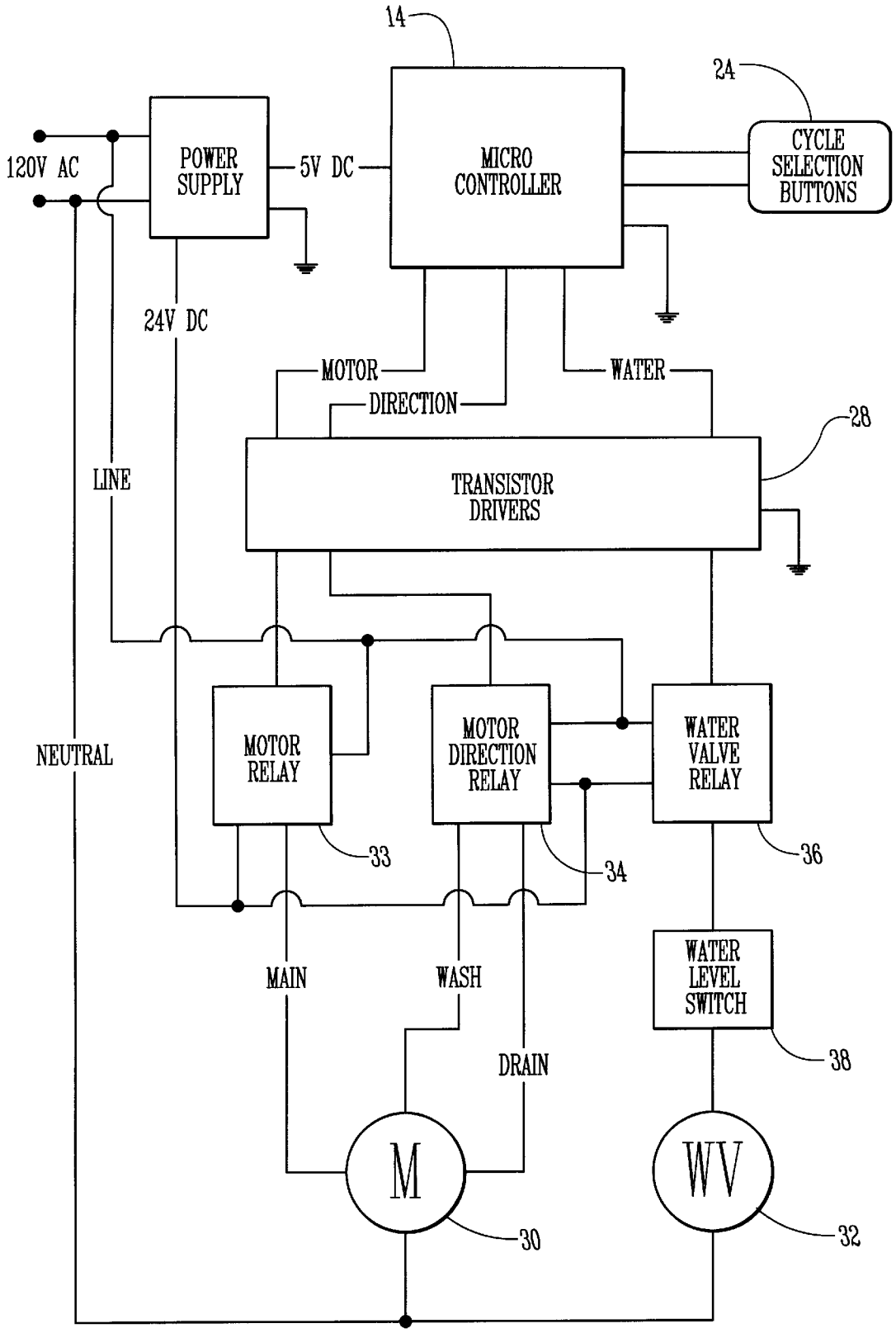
FIG. 3 shows a block diagram of the rinse and hold schematic.

The rinse and hold feature of the present invention is a cycle option that allows the user to rinse off a load of dishes in anticipation of a long delay between wash cycles. Without the rinse and hold feature, the user would have to manually rinse the dishes prior to loading the dishwasher or else the food or soil will dry on the dishes or result in food soil odors collecting in the dishwasher. FIG. 3 is a schematic block diagram of the rinse and hold function. FIG. 3 includes the microprocessor controller 14 which controls the operation of the dishwasher. The controller 14 sends control signals to the transistor drivers (shown as transistor drivers block 28) for controlling the operation of the motor 30 and the water valve 32. The control signals from the controller 14 are received by the transistor drivers 28 which then send signals to the motor relay 33, the motor direction relay 34, and the water valve relay 36. When the motor relay 33 receives a signal from the transistor drivers 28, the relay 33 activates the motor 30. When the motor direction relay 34 receives the appropriate signal from the transistor drivers 28, the direction of the motor 30 is controlled for use in either a wash or a drain cycle. Similarly, when the water valve relay 36 receives a signal from the transistor drivers 28, the water valve 32 is activated via the water level switch 38 which acts as a secondary control.

Figure 4:
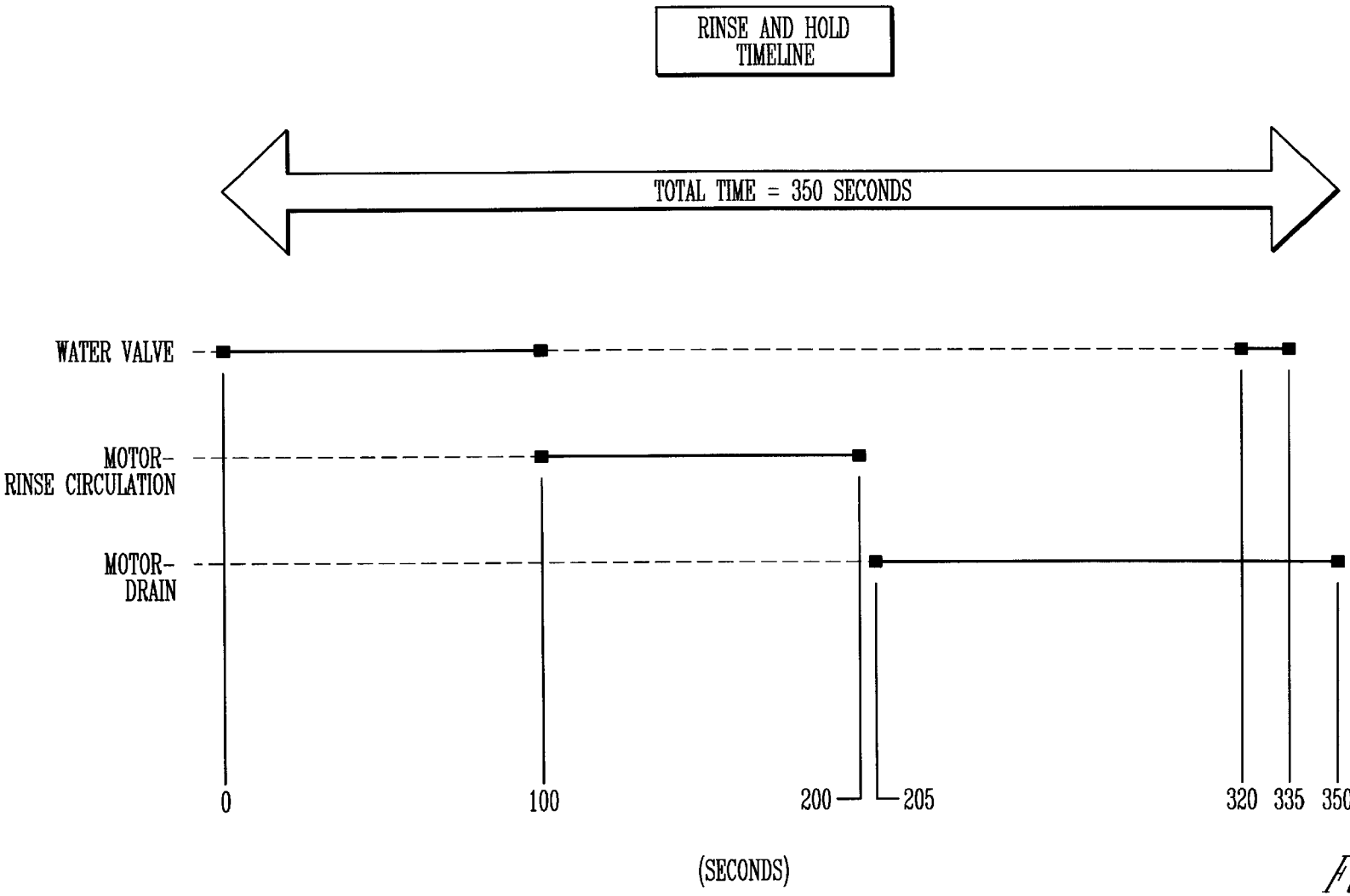
FIG. 4 shows a time line for the rinse and hold cycle including the water valve, motor circulation and motor drain.

FIG. 4 is a time line illustrating the operation of the rinse and hold function. In this example, the rinse and hold cycle takes 350 seconds to complete although the cycle could be accomplished in any number of ways. As shown in FIG. 4, the water valve 32 is activated and water is added to the dishwasher during the first 100 seconds of the rinse and hold cycle. For the next 100 seconds, the water valve 32 is turned off and the motor 30 is activated to circulate the water, rinsing off the dishes. There is a five second pause before the motor-drain is activated for 145 seconds. During the last portion of the drain, the water valve 32 is activated a second time, adding more water to the dishwasher. The second input of water results in a purging action which helps to reduce the concentration of food soil in the wash pump. In the preferred embodiment, when there are 30 seconds remaining in the drain portion of the cycle, the water valve 32 is activated for 15 seconds as shown in FIG. 4. The additional water added during the drain cycle reduces the amount of soil and odors present in the dishwasher after running the rinse and hold cycle. This allows the user to clear heavy soils from dishes so they do not dry on the dishes or cause odor to collect within the dishwasher.

During the drain portion of a normal wash cycle of the dishwasher, heavy soiled loads may cause the drain pump to lose the siphon effect leaving a greater than normal amount of dirty water in the bottom of the pump. As a result, at the start of the next wash, the water would be dirtier than normal since a smaller amount of clean water is introduced into the dishwasher. Similarly, more soil is left in the dishwasher which can be redeposited on the dishes when the water is circulated. The present invention also overcomes this problem by removing dirty water with an extra purge as described above when heavy soiled loads are sensed.

Figure 5:
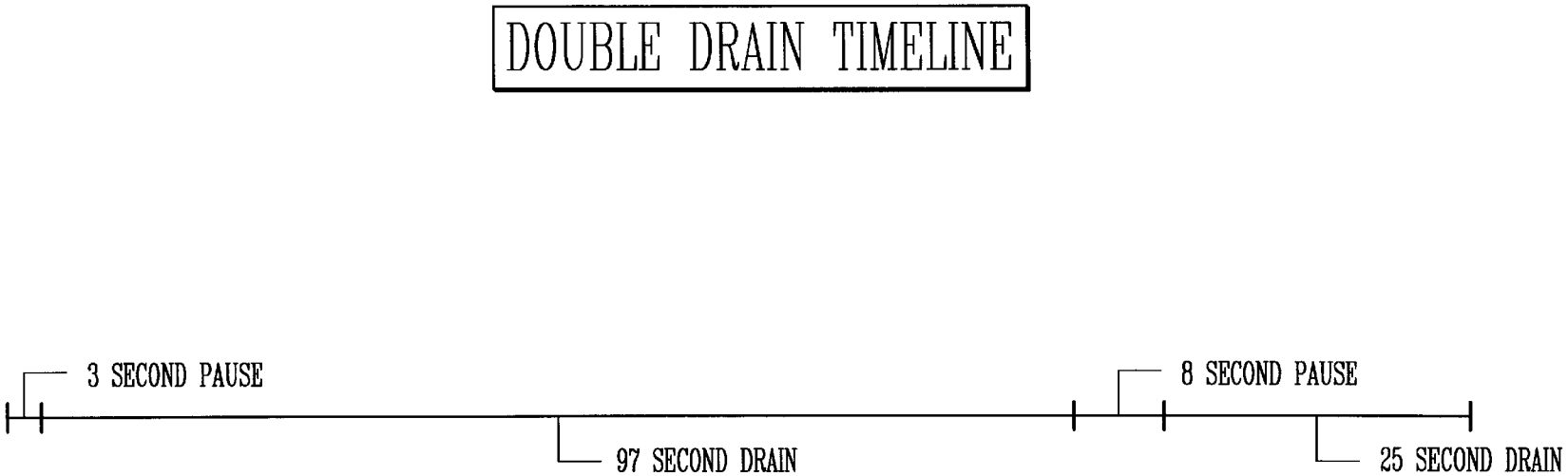
FIG. 5 shows a time line of the double drain cycle.

The dishwasher of the preferred embodiment uses a turbidity sensor, conductivity sensor, and wash arm RPM sensor to execute a cycle selection process, which determines whether a load is heavily soiled. If a heavily soiled load is sensed, then a double drain function is incorporated into the drain cycle to remove the extra soil. FIG. 5 is a time line showing the operation of the double drain function. The first drain is a ninety-seven second drain, the exact length of which is variable depending on the motor current. When the first drain is complete, there is an eight second pause followed by a twenty-five second drain to recreate the siphon effect and remove the soil and water. The double drain function is used only during the pre-washes before the main wash.

In a dishwasher, certain substances in the water may cause the water to foam and not wash the dishes as desired. These substances include for example, detergents, eggs, powder milks, etc. This reduces the effectiveness of the dishwasher. Another problem is present when there is a lot of material in the water which may cause the dishwasher pump to "starve" or not circulate the water properly. Foaming and starving are detected by monitoring the line current. If the line current drops while the wash arms have slowed, then a foaming or starved pump condition has occurred. Foaming is detected by a 10%–25% drop in the line current combined with a drop in the wash arm speed. Starving is detectable by a greater than 25% drop in line current with a stop of the wash arm rotation.

The present invention corrects the foaming problem by draining the water and foam immediately upon detection of the foam. During a normal fill of the dishwasher, the motor is turned off. However, if foaming is detected in the dishwasher, the motor is turned on during the fill subsequent to the indicated draining to allow as much water as possible to be added to the dishwasher since circulation of the water will add to the amount of water the dishwasher can hold. It is desired to add as much water as possible due to the possibility of the foam causing the fill control mechanism to trip prematurely. By recovering from the foaming in this manner, it is attempted to get rid of as much foam as possible in the drain cycle portion and add as much water in the fill cycle portion to create a normal wash action.

Similarly, to correct the starving in the dishwasher, the system water is drained immediately upon detection of starving. During the drain with approximately 30 seconds remaining, the water is turned on to attempt to clean excess food matter out of the pump. The dishwasher is then filled above the normal level by adding 10 seconds of filling after the motor has been turned on. This again allows as much water to be added to the dishwasher as possible since circulation of the water adds to the amount the dishwasher can hold. It is desired to add as much water as possible to allow the pump to work properly with the amount of food soil present in the dishwasher. By recovering from starving in this manner, it is attempted to get rid of as much of the food soil as possible in the drain portion, and add as much water in the fill portion to create a normal wash action.

Figure 6:
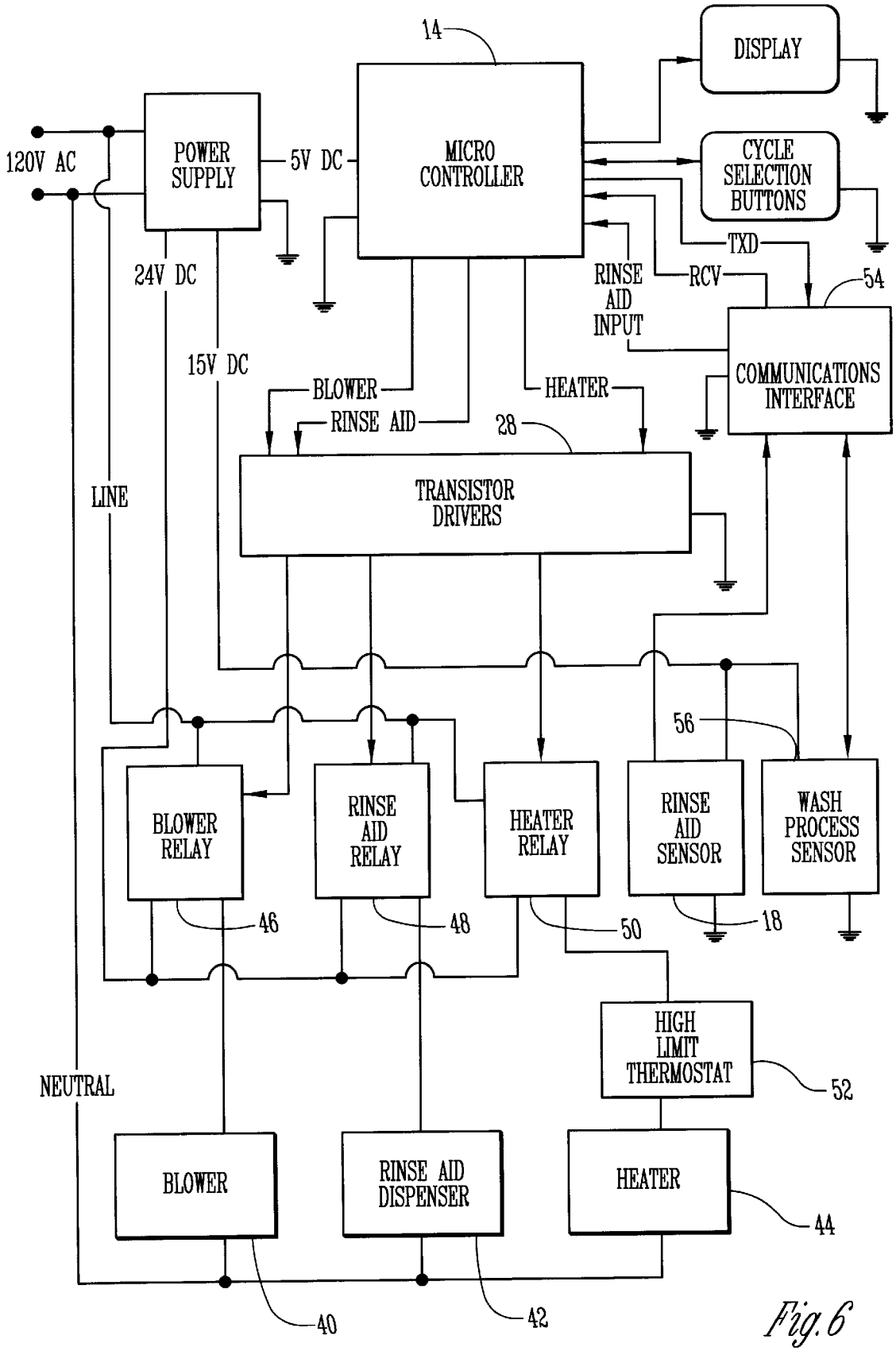
FIG. 6 shows a block diagram of the dry control schematic.

FIG. 6 is a schematic block diagram of the dry control function. FIG. 6 includes the microcontroller 14 which controls the operation of the dishwasher. The controller 14 sends control signals to the transistor drivers 28 for controlling the operation of the blower 40, rinse aid dispenser 42, and heater 44. The control signals from the controller 14 are received by the transistor drivers 28 which then send signals to the blower relay 46, rinse aid relay 48, and heater relay 50. When the blower relay 46 receives a signal from the transistor drivers 28, the relay 46 activates the blower 40. In the same way, when the rinse aid relay 48 receives the appropriate signal from the transistor drivers 28, the rinse aid dispenser 42 is activated. When the heater relay 50 receives a signal from the transistor drivers 28, the heater 44 is controlled via high limit thermostat 52. FIG. 5 also includes a communications interface 54 which communicates with the controller 14, the rinse aid sensor 18, and a wash process sensor 56.

Figure 7:
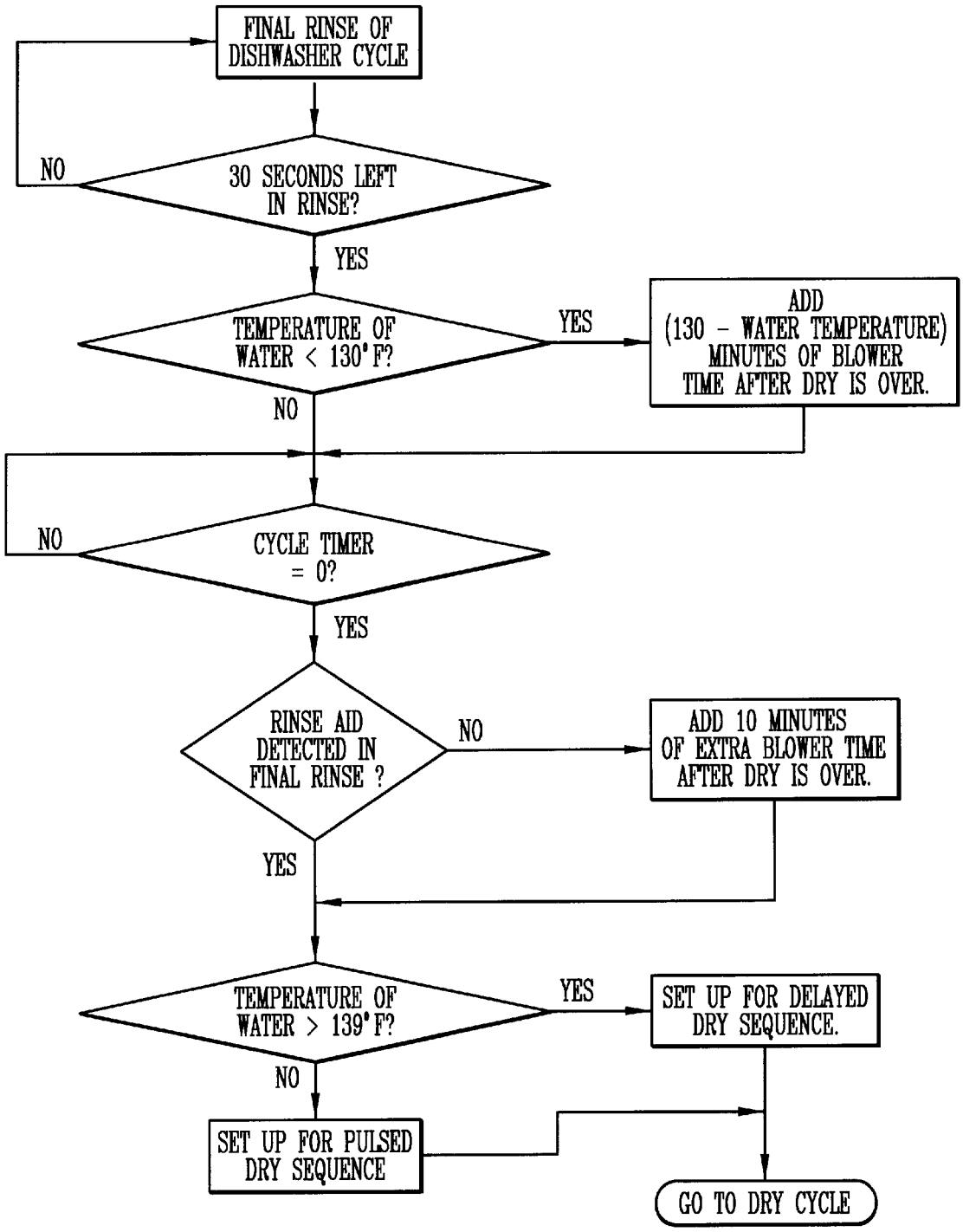
FIG. 7 shows a flow chart of the dry cycle.

FIG. 7 is a flow chart showing how the dishwasher controller 14 controls the dry cycle. The dry cycle is comprised of a combination of providing heat to the dishwasher and blowing air through the dishwasher tub (not shown) and over the dishes. The dry cycle works as follows and as shown in FIG. 7. When there are 30 seconds left in the final rinse portion of the dishwasher cycle, the water temperature is measured. If the temperature of the water is less than 130° Fahrenheit, then an amount of additional blower time is added to the end of the dry period equal to 130 minus the measured water temperature. For example, if the measured water temperature is 1250, then 5 minutes (130 minus 125) will be added to the blower time. The equation is not critical as long as the blower time is increased if the water temperature is lower than a certain level. In the preferred embodiment, blower time will not be subtracted for higher temperatures. Blower on time has a direct relationship to the final dryness of the dishes. The longer the blower input the dryer the dishes will be.

At the end of the final rinse portion of the dishwasher cycle, the presence of a rinse aid is detected. The presence of a rinse aid is detected by measuring the turbidity of the water after the rinse aid should have been dispensed and comparing the measured turbidity to a known turbidity for clear water. Note that the dishwasher includes a rinse aid sensor (reference 18 in FIG. 2), but for purposes of the dry cycle, the presence of rinse aid is checked using the turbidity sensor. If no rinse aid is detected, then 10 minutes of blower time are added to the dry cycle.

If the water temperature is greater than 139° Fahrenheit, then the dishwasher will delay activating the heater until the blower is turned on. This is called the delayed dry sequence and is discussed below. If the temperature during the last rinse is below 139°, a pulsed dry sequence (discussed below) is initiated rather than the delayed dry sequence.

If the delayed dry sequence is selected, then the heater and blower both turn on at 400 seconds into the dry cycle. The heater remains on for approximately 600 seconds. The blower remains on up until 2100 seconds (35 minutes) into the dry cycle plus any time added during the final rinse cycle (see the discussion above).

If the pulsed dry sequence is selected, the heater is turned on for 200 seconds at the beginning of the dry cycle and then turned off for 100 seconds. The heater is then turned back on for 200 seconds and turned off for 100 seconds. The heater is then turned back on for the last time for 200 seconds. The blower is turned on at 400 seconds into the dry cycle which is 100 seconds into the second of the three heat pulses. The blower remains on for 2100 seconds (35 minutes) from the beginning of the dry cycle plus any time added during the final rinse cycle (see the discussion above). Note that whether the delayed dry sequence or the pulsed dry sequence is selected, the heater will be turned on for a total of approximately 600 seconds. It would also be possible to use a delayed and pulsed heat sequence. However, the two sequences described are the most preferred. Note that when the delicate wash cycle is selected, all the heat in the dry cycle will be delayed regardless of the water temperature. The purpose of the pulsed and delayed dry sequences is to keep the temperature in the dishwasher down. If the temperature in the dishwasher gets too high, the thermostat 52 will trip, causing no heat to be added until the thermostat 52 resets.

The dishwasher of the present invention is also capable of determining the type of dishes in the dishwasher based on the rise in temperature during a wash cycle. At times it is desirable to know what type of dishes are loaded in a dishwasher, for example, ceramic versus plastic. A "smart" dishwasher could use this information to help in the selection of dishwasher cycles. In addition, since plastic dishes are more difficult to dry, steps need to be taken by the controller 14 in order to dry the dishes in the most efficient manner. Simply adding more heat is not always necessary or desirable, especially with ceramic dishes and metal pans. If a controller 14 can determine what type of dishes are in the dishwasher, then the controller 14 can select the most effective and efficient cycles accordingly. One method of determining the type of dishes in the dishwasher is to monitor the rise in temperature of the washing chamber during a wash cycle. If the temperature rises quickly, that would be an indication of low density dishes such as plastic which cannot absorb very much heat. Alternatively, if the temperature rises slowly, that would be an indication of more dense dishes such as ceramic or metal which absorb more heat. The same method could be used during the dry cycle rather than a wash cycle. An alternative method of determining the type of dishes would be to monitor the temperature of water in the bottom of the dishwasher after it has been injected into the dishwasher at a known temperature. Since the temperature of the dishwasher is influenced by the temperature of the water and the heat absorbing capacity of the dishes, a measure of the type of dishes in the dishwasher can be made.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. An electronic control system for an automatic dishwashing machine for washing articles having a drying cycle with at least a first and second drying sequence comprising:

a controller for controlling the operation of the dishwashing machine;

a heat source for providing heat to the articles during at least a portion of the drying cycle; and a water temperature sensor for sensing the temperature of the water in the dishwashing machine, wherein the predetermined time can be modified by the controller depending on the sensed temperature of the water and wherein one of said first and second drying sequences is selected depending on the sensed temperature of the water.

2. The electronic control system of claim 1 wherein the first drying sequence is selected if the sensed temperature is greater than a certain temperature and the second drying sequence is selected if the sensed temperature is less than the certain temperature.

3. The electronic control system of claim 1 wherein the second drying sequence is a delayed dry sequence initiated when the temperature of the water exceeds a predetermined temperature.

4. The electronic control system of claim 3 wherein the heat source is activated after a delay period following the beginning of the dry cycle.

5. The electronic control system of claim 4 wherein the delay period is 400 seconds.

6. The electronic control system of claim 1 wherein the first drying sequence is a pulsed dry sequence.

7. The electronic control system of claim 6 wherein the heat source is pulsed on and off during the dry cycle.

* * * * *